US005803835A

United States Patent [19]

Moton et al.

[11] Patent Number: 5,803,835

[45] Date of Patent: Sep. 8, 1998

[54] MUSICAL HOP SCOTCH GAME KIT

[76] Inventors: James M. Moton; Shelia H. Moton; Gia T. Moton, all of 14138 Bradby La., Smithfield, Va. 23430

[21] Appl. No.: 762,161

[22] Filed: Dec. 9, 1996

[51] Int. Cl.[6] ..... A63B 67/00

[52] U.S. Cl. ..... 473/414; 84/721

[58] Field of Search ..... 473/414; 84/721

[56] References Cited

U.S. PATENT DOCUMENTS

| | | | |
|---|---|---|---|
| 3,091,454 | 5/1963 | Sam | 473/414 |
| 3,749,810 | 7/1973 | Dow . | |
| 3,775,546 | 11/1973 | Honegger . | |
| 3,922,944 | 12/1975 | Kurosaki . | |
| 3,927,880 | 12/1975 | Petrusek | 473/414 X |
| 4,121,488 | 10/1978 | Akiyama . | |
| 4,848,743 | 7/1989 | Rozek | 473/414 |
| 5,277,429 | 1/1994 | Smith | 273/237 |

FOREIGN PATENT DOCUMENTS

| | | | |
|---|---|---|---|
| 2015801 | 9/1979 | United Kingdom | 84/721 |

*Primary Examiner*—William H. Grieb
*Attorney, Agent, or Firm*—Wallace J. Nelson

[57] ABSTRACT

A game kit including a pliable hop scotch mat, an electrical actuated sound producing component and a plurality of individual electrical switches disposed between layers of the mat and adapted to be individually closed by pressure from a game participant when stepping on each of the designated areas on the game mat. The individual switches are positioned on each of the designated step or hop locations on the game mat. A battery power supply and speaker(s) are provided in a control unit housing the sound producing component and are in electrical connection with circuity leading from each of the individual pressure switches. The produced sound may be ringing of a bell, an individual music note, or a sequence of notes collectively playing a musical tune.

4 Claims, 2 Drawing Sheets

MUSICAL HOP SCOTCH GAME KIT

BACKGROUND OF THE INVENTION

This invention relates to games in general and relates specifically to a hop scotch game kit including a game mat wherein a musical sound is produced at each step made on the hop scotch mat by a game participant.

SUMMARY OF THE INVENTION

One of the oldest known games participated in by preschool, and early elementary school children, is "hop scotch". Sometimes the hop scotch diagram is marked off with a stick on the ground surface, or with chalk or crayon on sidewalks, driveways, on playground surfaces, and the like. In some instances, graphic pre-designed mats are employed as the stepping, or hopping, route to be taken by the game participants. It is also known to provide a hop scotch type game with sound producing pop-bubbles contained in the mat (U.S. Pat. No. 4,848,743).

It is an object of the present invention to provide a new dimension to the game by providing a musical sound producing feature to the hop scotch game.

Another object of the present invention is to provide a hop scotch game kit which can be marketed as a game unit.

A further object of the present invention is to provide a hop scotch game that is easy to assemble on any flat surface.

SUMMARY OF THE INVENTION

According to the present invention, the foregoing and additional objects are attained by providing a game kit including a pre-designed hop scotch game mat with each marked step on the mat housing an electrical switch. An open electrical circuit leads from each electrical switch to a control unit housing an electrically actuated sound producing device. The control unit also houses a battery power supply and a music sound producing device. A speaker for transmitting the musical sound produced is provided within the control unit, with an additional speaker or speakers being electrically connected thereto, when so desired. In operation, when a game participant steps on any of the marked locations, the associated switch therein is closed to cause a musical sound to be emitted from the sound producing box. These musical sounds can be single musical notes, such as the musical scale, or a combination of notes denoting a specific musical composition and are sequentially emitted as the game participant progresses toward "home" on the game mat.

BRIEF DESCRIPTION OF THE DRAWINGS

A more complete appreciation of the invention and many of the attendant advantages thereof will be more readily apparent as the same becomes better understood when considered in connection with the accompanying drawings wherein.

DETAILED DESCRIPTION

Figure 1:
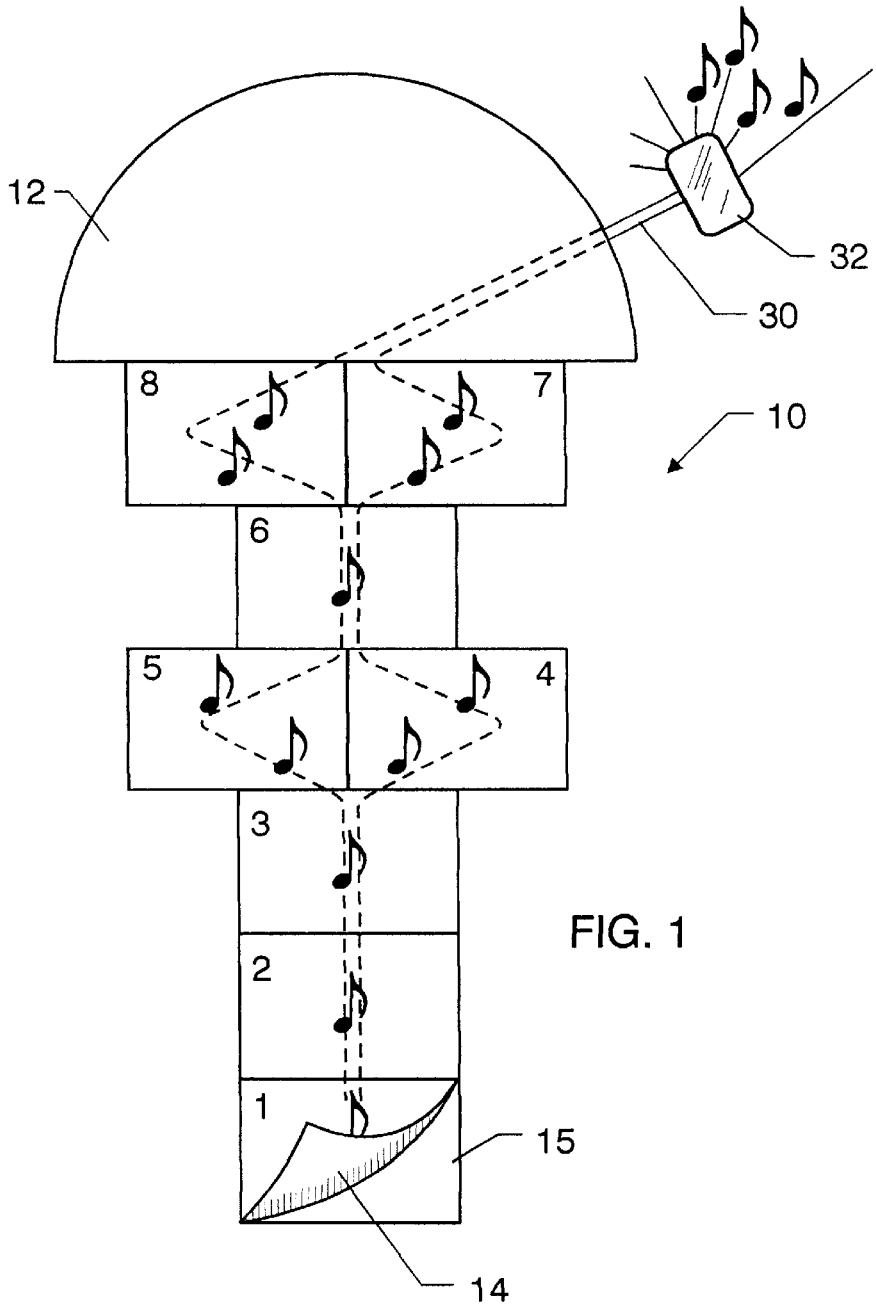
FIG. 1 is a schematic plan view, with parts exposed, of a hop scotch mat according to the present invention.

Referring to the drawings, and more particularly to FIG. 1, there is shown an exemplary hop scotch mat forming a part of the game kit of the present invention, and designated generally by reference numeral 10. As illustrated, mat 10 is cut to the shape of a hop scotch game having eight designated single or double steps as numbered thereon and a "home" base 12 at the end of the eight steps. Step 1 of the mat 10 is shown with a portion of the top surface layer 14 thereof turned back to illustrate the bottom surface layer 15, as will be further described hereinafter.

Figure 2:
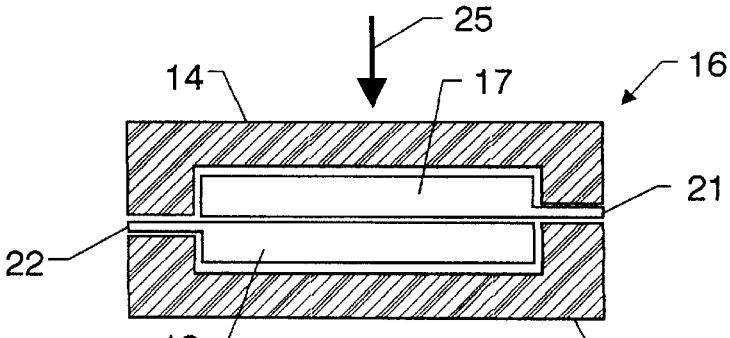
FIG. 2 is a schematic sectional view of one of the individual switches employed on t he step sections of the hop scotch mat shown in FIG. 1.

Referring now to FIG. 2, a pressure electrical switch, generally designated by reference numeral 16, is disposed between top surface layer 14 and bottom surface layer 15 of mat 10. Pressure electrical switch 16 includes a first metal contact 17 and a second metal contact 18, provided with respective electrical leads 21,22, the function of which will be further explained hereinafter. In the normal position, contacts 17 and 18 are maintained in spaced relationship, and when pressure is applied in the direction of arrow 25, as caused by a game participant stepping on the mat 10 surface at the location of switch 16, contacts 17 and 18 are closed, as will be further explained hereinafter.

Figure 3:
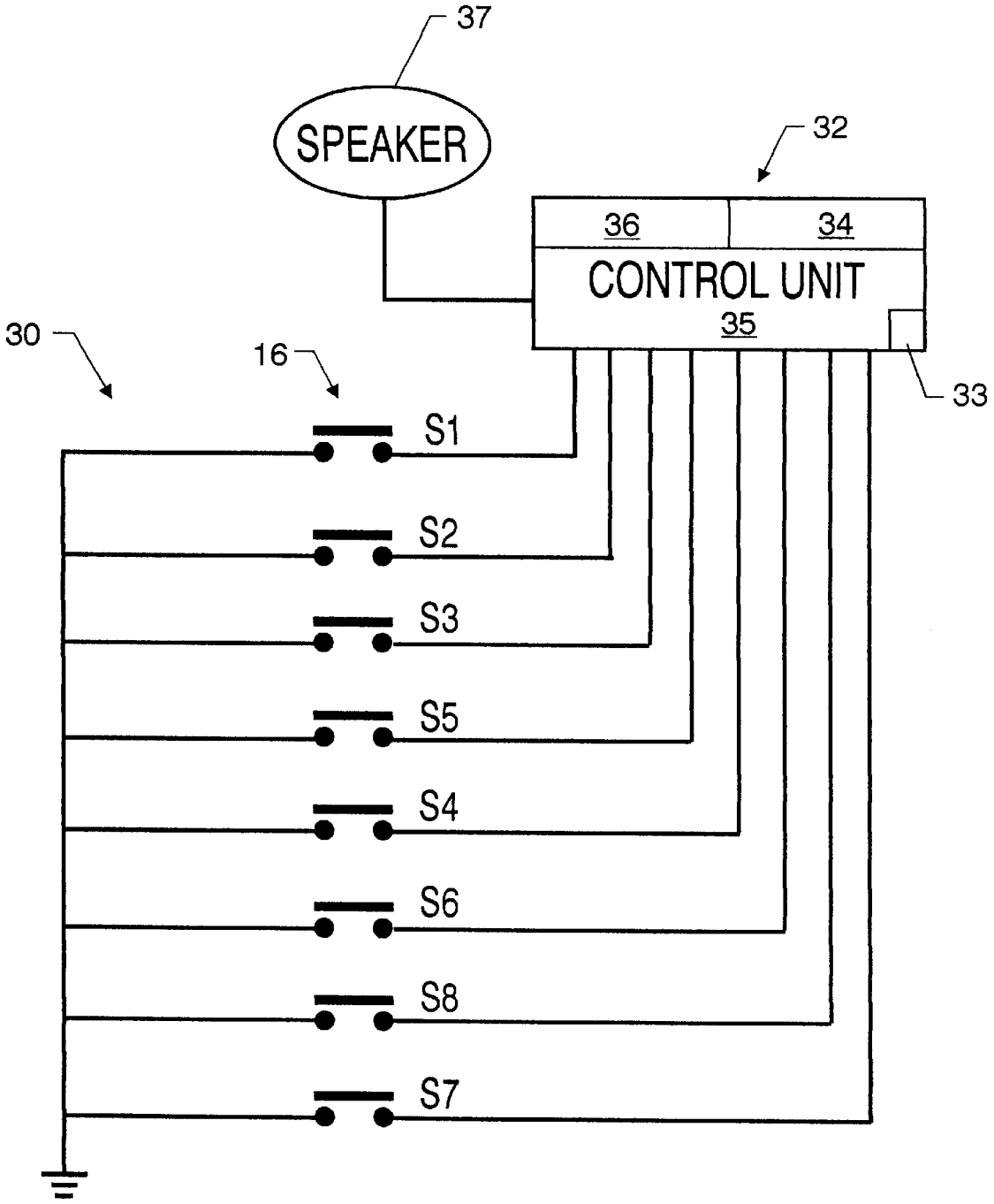
FIG. 3 is a schematic circuit diagram illustrating the electrical connection between the individual switches on the hop scotch mat and the sound control unit.

Referring now to FIG. 3, an electrical circuit 30 is shown and includes eight pressure actuated switches designated, respectively, by S1, S2, S3, S4, S5, S6, S7 and S8. Switches S1 through S8 represent the pressure switches contained in hop scotch mat 10, and correspond to the designated eight steps or game participant positions on mat 10. Thus, switch S1 is the same as switch 16 described hereinbefore in reference to FIG. 2. Switches S2 through S8 are of identical construction as switch S1 (16) and are not further described herein in the interest of brevity. Electric circuit 30 includes a control unit, designated by reference numeral 32, and including a conventional on/off switch 33. A battery pack 34 within control unit 32 contains a battery or batteries (not illustrated) of adequate voltage to actuate a sound producing component 35. The sound emanating from sound producing component 35 is amplified in a conventional manner and transmitted through a speaker 36, also carried by control unit 32. An additional speaker 37 is also optionally connected to the sound producing component 32, when so desired. Sound producing component 35, in the preferred embodiment, is a music sound producer with the music provided therefrom being in the form of a single note, such as the conventional music scale, or each musical sound can be in the form of a series of notes that, taken together, may or may not constitute a known musical selection.

Hop scotch mat 10 is formed of any suitable pliable material, such as a plastics, rubber, cardboard or heavy paper, that permits rolling or folding for packaging in a kit format. In the preferred embodiment, mat 10 is formed of a vinyl plastic, such as polyvinylchloride.

Although, in the preferred embodiment of the invention, a music producing sound is employed, one or more electrical actuated bells or voice recordings, may be employed as the sound producing component, if so desired, without departing from the scope of the invention.

It is therefore to be understood that the specific embodiments of the invention described herein are given by way of example to illustrate the invention and there are variations that may be made without departing from the spirit and scope of the invention. For example, instead of mat 10 being in the actual shape of the hop scotch game, mat 10 could be of an enlarged rectangular configuration with the game lay-out printed thereon. There are obviously, many other variations and modifications of the invention that will be apparent to those skilled in the art in the light of the above description. It is therefore to be understood that, within the scope of the appended claims, the invention may be practiced other than as specifically described herein.

What is claimed as new and desired to be secured by Letters Patent of the United States is:

1. A game kit comprising:

a pliable mat having indicia thereon representing a hop scotch game with individual positions thereon to be stepped on by a game player;

an electrical switch carried by said mat at each position to be stepped on by a game player;

said electrical switch being a pressure actuated switch and normally in the open position when no pressure is applied thereto and being movable to a closed position when stepped on by a game player;

an electrical circuit in connection with each said electrical switch;

a control unit electrically connected through said electrical circuit to each said electrical switch;

said control unit containing (a) a power supply, (b) a music producing device and (c) at least one speaker;

said power supply consisting of at least one battery for supplying power to operate said music producing device;

each said electrical switch serving to close said electric circuit and initiate a music response from said music producing device when stepped on by a game player.

2. The game kit of claim 1 including an additional speaker in connection with said electrical circuit and disposed external to said control unit.

3. The game kit of claim 1 wherein said pliable mat is formed of a top and a bottom layer of material secured together to form a unitary mat and wherein each said electrical switch is positioned between said top and said bottom layers, and said pliable mat is formed of a layered material selected from the group of materials consisting of plastics, rubber, cardboard, and heavy paper.

4. The game kit of claim 3 wherein the pliable mat is formed of a plastic material and the plastic material is a vinyl plastic.

* * * * *